US006470634B1

(12) United States Patent
Bloom, Sr.

(10) Patent No.: US 6,470,634 B1
(45) Date of Patent: Oct. 29, 2002

(54) FREEZER DOOR BUMPER GUARD

(76) Inventor: Michael E. Bloom, Sr., P.O. Box 970, 2900 Rockwell Rd., Rockwell, NC (US) 28138

( * ) Notice: Subject to any disclaimer, the term of this patent is extended or adjusted under 35 U.S.C. 154(b) by 0 days.

(21) Appl. No.: 09/566,711

(22) Filed: May 9, 2000

(51) Int. Cl.[7] ..... E04H 6/42

(52) U.S. Cl. ..... 52/174; 52/801.1; 248/345.1; 49/462; 49/50

(58) Field of Search ..... 52/801.1; 248/345.1; 49/462, 50

(56) References Cited

U.S. PATENT DOCUMENTS

| | | | | | |
|---|---|---|---|---|---|
| 2,821,941 | A | | 2/1958 | Reed | |
| 3,451,319 | A | | 6/1969 | Gubela | |
| 3,470,666 | A | | 10/1969 | Mod et al. | |
| 3,815,285 | A | | 6/1974 | Kuyper | |
| 3,975,564 | A | * | 8/1976 | Jones | 428/174 |
| 4,239,122 | A | | 12/1980 | Klein | |
| 4,453,562 | A | | 6/1984 | Palkovics | |
| 4,648,152 | A | * | 3/1987 | Grewall | 16/82 |
| 4,681,302 | A | | 7/1987 | Thompson | |
| 4,752,153 | A | | 6/1988 | Miller | |
| 4,991,639 | A | | 2/1991 | Clay, Jr. et al. | |
| 5,199,759 | A | * | 4/1993 | Anderson | 292/288 |
| 5,368,349 | A | * | 11/1994 | Hebert et al. | 292/343 |
| 5,488,804 | A | * | 2/1996 | Batscher | 49/462 |
| 5,511,837 | A | * | 4/1996 | Dempsey et al. | 292/288 |
| 5,649,396 | A | | 7/1997 | Carr | |
| 5,697,656 | A | * | 12/1997 | Hebert et al. | 292/343 |
| 5,761,766 | A | * | 6/1998 | Basham | 16/85 |

* cited by examiner

*Primary Examiner*—Carl D. Friedman
*Assistant Examiner*—Christy Green
(74) *Attorney, Agent, or Firm*—Adams, Schwartz & Evans, P.A.

(57) ABSTRACT

A door guard for protecting a doorframe and including a deflecting member having a vertically-oriented, planar, and horizontally-elongate deflecting surface adapted for being positioned adjacent to a side of a doorframe and projecting outwardly therefrom at an oblique angle thereto for deflecting a colliding object away from the doorframe.

12 Claims, 12 Drawing Sheets

FREEZER DOOR BUMPER GUARD

TECHNICAL FIELD AND BACKGROUND OF THE INVENTION

This invention relates to a door guard particularly intended to protect, for example, the frames of doors on industrial freezers, storage lockers or units and the like located in warehouses, grocery stores or similar business establishments. In many instances, a freezer, storage locker or other storage unit will be installed in a warehouse without having any type of protection placed around its doorframe. Under such circumstances, nothing is in place to prevent an object such as a forklift or pallet from colliding with the doorframe and causing significant damage. Such repeated collisions cause undue wear on the doorframe, and contribute to premature replacement of the frame or in some cases, the entire storage unit. In addition, such collisions result in damage to forklifts and pallets, and increase the risk of loss of the inventory being transported.

The door guard of the present invention provides a simple and effective way to avoid such damage and loss. The invention uses commonly available materials and components which may be easily and inexpensively manufactured, and supplied to the user in many different forms, resulting in a door guard adapted for being anchored adjacent to doorframe and to a floor. The door guard takes advantage of planar surfaces to deflect colliding objects away from the doorframe, thereby significantly reducing the risk of damage to doorways, and associated forklifts, transport equipment, and inventory. Although the door guard is designed with protecting the doorframe of a freezer or other storage unit in mind, the door guards of the present invention are ideal for protecting the doorframes of a variety of entryways.

SUMMARY OF THE INVENTION

Therefore, it is an object of the invention to provide a door guard which protects the doorframe of a freezer, storage locker or other storage unit by deflecting colliding objects away from the doorframe.

It is another object of the invention to provide a door guard for having at least one deflecting surface including a large impact surface area upon which an object may collide and be deflected away from the doorframe, thereby reducing the total distance through which the object travels during deflection.

It is another object of the invention to provide a door guard which is inexpensive and easy to manufacture from commonly available components.

It is another object of the invention to provide a door guard which may be easily removed from one surface, moved, and then anchored to another surface.

These and other objects of the present invention are achieved in the preferred embodiments disclosed below by providing a door guard for protecting a doorframe. The door guard includes a deflecting member having a vertically-oriented, planar, and horizontally-elongate deflecting surface adapted for being positioned adjacent to a side of the doorframe and projecting outwardly therefrom at an oblique angle thereto for deflecting a colliding object away from the doorframe.

According to one embodiment of the invention, the deflecting member is anchored to a floor surface.

According to another embodiment of the invention, the deflecting member is anchored adjacent to, and at least halfway up, the side of the doorframe.

According to yet another embodiment of the invention, the deflecting member is a dihedrally-shaped converging surface including two faces intersecting to form an outwardly extending edge.

According to yet another embodiment of the invention, the deflecting member is a wedge-shaped structure including at least one vertically-oriented face.

According to yet another embodiment of the invention, the wedge-shaped structure defines an isosceles triangle having an unequal side positioned in alignment with, and two equal sides converging outwardly away from, the doorframe and affixed together by attachment means.

According to yet another embodiment of the invention, the wedge-shaped structure has first, second and third equilateral sides affixed together by attachment means, thereby forming the wedge. The first equilateral side is positioned in alignment with the doorframe and the second and third equilateral sides converge outwardly from the doorframe.

According to yet another embodiment of the invention, the wedge includes a top for providing support to the wedge.

According to yet another embodiment of the invention, the wedge-shaped structure includes a reinforcement member for providing additional support to the wedge-shaped structure. The reinforcement member is positioned intermediate the top and the bottommost edge of the deflecting member. The flange is attached to the deflecting member and includes a plurality of spaced-apart holes defined by the flange, which are adapted for receiving bolts therethrough.

According to yet another embodiment of the invention, the length of the sides is at least two times greater than the height of the sides.

According to yet another embodiment of the invention, the door guard includes an outwardly extending attachment flange for securing the deflecting member to a floor. The flange is attached to the deflecting member and includes a plurality of spaced-apart holes defined by the flange. The holes are adapted for receiving bolts therethrough.

According to yet another embodiment of the invention, the door guard is comprised of steel.

According to yet another embodiment of the invention, the door guard is comprised of high-density plastic.

The attachment means are preferably a plurality of welded seams.

According to yet another embodiment of the invention, the pointed edge includes a rubber cap extending along and covering the edge for absorbing the direct impact of a colliding object and for minimizing damage resulting to the object and to the doorframe from the impact.

According to yet another embodiment of the invention, the door guards are positioned adjacent to a doorframe and on opposite sides of a doorway, thereby cooperating to deflect colliding objects away from the doorframe.

Brief Description of the Drawings

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
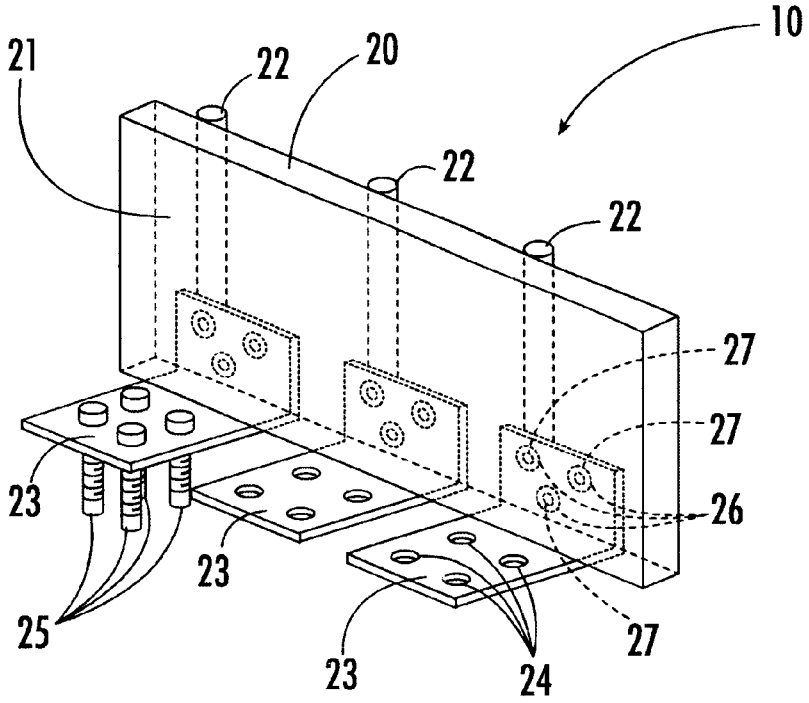
FIG. 1 is a perspective view of a door guard according to one embodiment of the invention.
Figure 2:
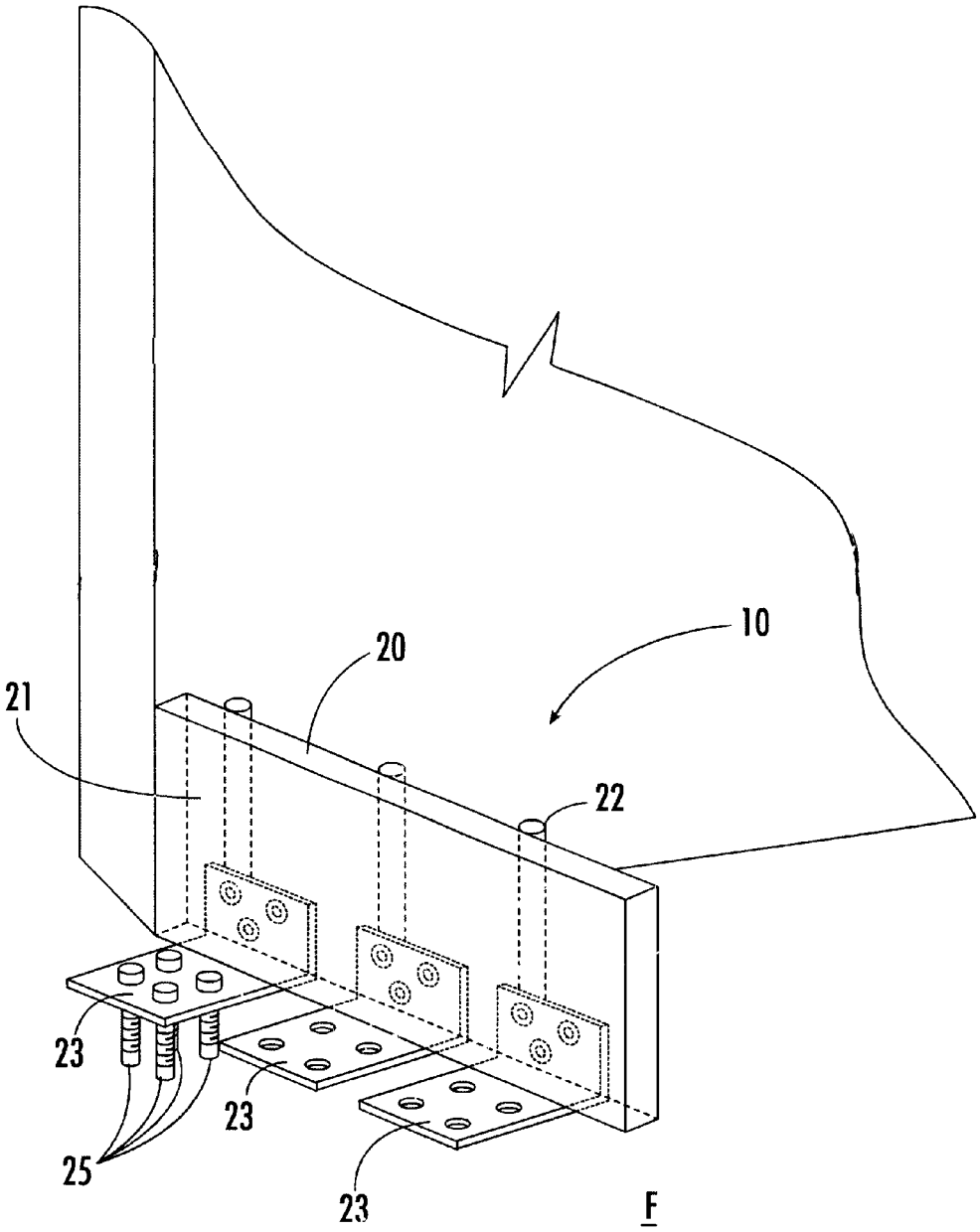
FIG. 2 is a perspective view of the door guard according to FIG. 1 attached to a floor and adjacent to a door frame.

Referring now specifically to the drawings, a door guard according to the present invention is illustrated in FIGS. 1 and 2 and shown generally at reference numeral 10. The door guard 10 includes a deflecting member 20 having a deflecting surface 21 for deflecting colliding objects away from the door frame, at least three support rods 22, which are shown drawn in phantom, for supporting the door guard 10 and maintaining the deflecting member 20 in an upright position, and a plurality of attachment plates 23 for anchoring the door guard 10 to a floor. The deflecting member 20 is preferably formed from a durable metal such as steel or aluminum or a high-density plastic such as polyethylene or polypropylene. Although the deflecting member 20 may be any shape or size, the deflecting member 20 preferably has a vertically-oriented, planar, and horizontally-elongate shape. Furthermore, although the deflecting member 20 can be of any length, height or thickness, a preferred thickness is at least ½ inch, with a length that is at least two times greater than the height. The support rods 22 are preferably steel rods with a diameter of approximately ½ inch.

Each attachment plate 23 is preferably formed from a steel plate having a thickness of 3/16 inch, and includes a plurality of holes 24 defined therein through which anchors 25 are placed for securing the door guard 10 to a floor, and a plurality of holes 26, which are shown drawn in phantom, defined therein through which bolts 27, which are also shown in phantom, are placed for securing the plates 23 to the deflecting member 20. Each hole 24 or 26 is preferably drilled through the plate 23 using a hammer drill, and has a diameter of approximately ½ inch adapted for receiving a complementary anchor 25 or bolt 27 therethrough. Although any suitable concrete anchor can be used, the anchors 25 are preferably wedge-type expansion anchors having a diameter equal to that of the hole 24 and including complementary threads which permit the hole 24 to receive the anchor for securing the door guard 10 to the floor. Likewise, any suitable bolt may be used; however, each bolt 27 preferably has an Allen head a diameter of ½ inch. FIG. 1 shows each anchor 25 and bolt 27 positioned in a complementary hole 24 or 26, respectively. FIG. 2 shows a single door guard 10 anchored to a floor "F". The floor "F" is preferably concrete, a steel plate, or some other similar hard substance.

Figure 3:
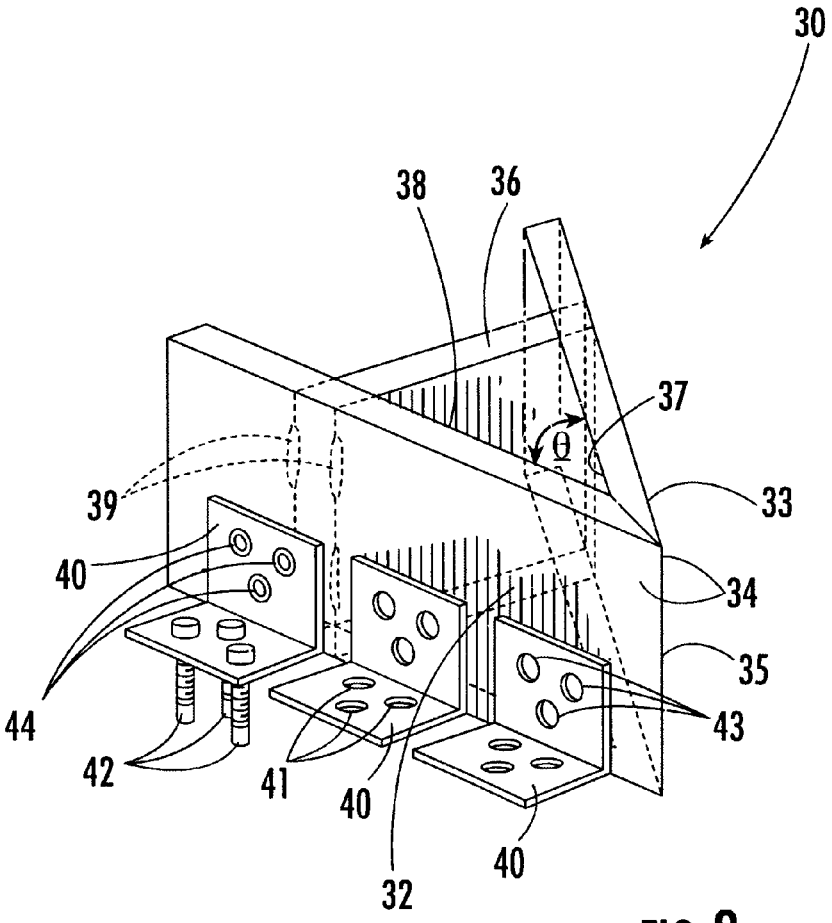
FIG. 3 is a perspective view of another door guard according to one embodiment of the invention.

Referring now to FIG. 3, a door guard according to the present invention is illustrated and shown generally at reference numeral 30. The door guard 30 includes first and second outer faces 32 and 33, respectively, which intersect to form a dihedrally-shaped converging surface 34, having an outwardly extending edge 35. The converging surface 34 is dihedrally-shaped due to the interior 1.0 angle θ which is formed where an inner face 37 and an inner face 38 converge. A reinforcement member 36 is affixed to inner faces 37 and 38 by welded seams 39, which are shown drawn in phantom. The reinforcement member 36 provides additional support to the door guard 30 during collisions. Although the reinforcement member may be of any shape or size, or include any number ofcomponents, the reinforcement member 36 is preferably formed in a vertically-oriented, planar, and horizontally-elongate shape. The door guard 30 is preferably formed from steel plates having a thickness of ½ inch.

The door guard 30 also includes a plurality of attachment plates 40 attached along the bottom edges of outer faces 31 and 32 for anchoring the door guard 30 to a floor. Each plate 40 is preferably formed from a steel plate having a thickness of 3/16", and includes a plurality of holes 41 defined therein through which anchors 42 are placed for securing the door guard 30 to a floor "F", and a plurality of holes 43 defined therein through which bolts 44 are placed for securing the door guard 30 to a wall "W". Each hole 41 or 43 is preferably drilled through the plate 40 using a hammer drill, has a diameter of approximately ½ inch adapted for receiving a complementary anchor 42 or bolt 44 therethrough. Although any suitable concrete anchor or bolt may be used, the anchors 42 and bolts 44 are preferably the same as those used with the door guard 10 shown in FIGS. 1–3. FIG. 3 shows each anchor 42 and bolt 44 positioned in a complementary hole 41or 43, respectively.

Figure 4:
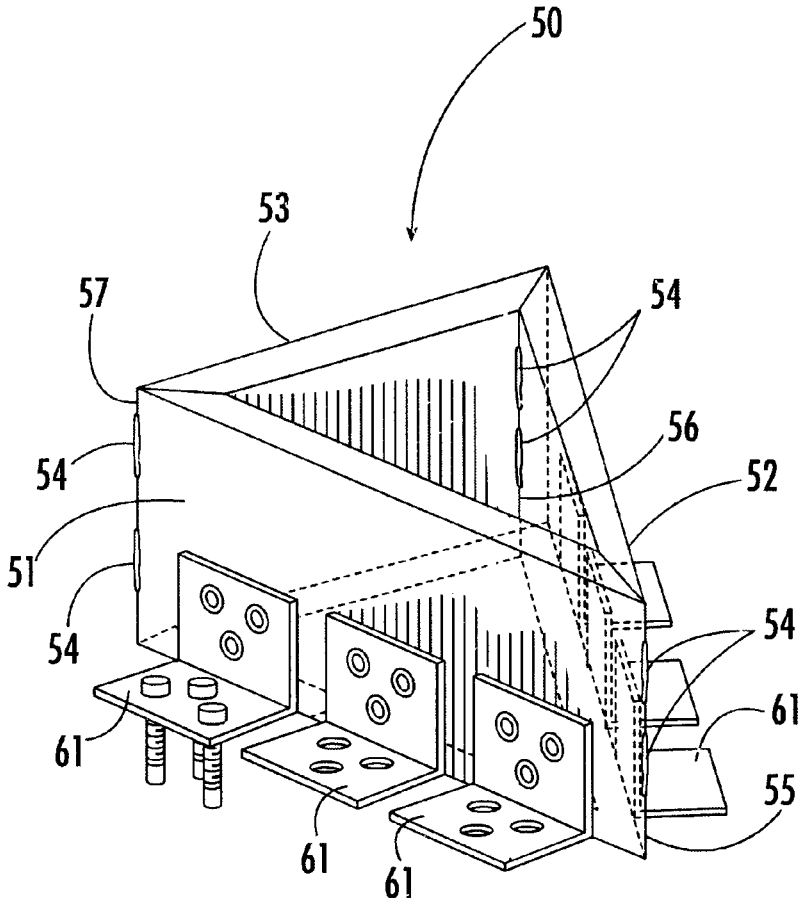
FIG. 4 is a perspective view of another door guard according to one embodiment of the invention.

Referring now to FIG. 4, a door guard according to another embodiment of the invention is shown generally at reference numeral 50. The door guard 50 is preferably wedge-shaped, and includes first, second and third faces 51, 52, and 53, respectively, which intersect and are attached together by welded seams 54 to form respective converging edges 55, 56 and 57. Each face 51, 52, or 53 is preferably formed from a steel plate having a thickness of approximately ½", and upper and lower inwardly-facing reinforcements. The door guard 50 also includes a plurality of attachment plates 58 attached along the bottom edges of faces 51 and 52 for anchoring the door guard 50 to a floor. Each plate 58 is formed from the same materials, includes the same components, and is installed in the same manner as the plates 26 and 40 employed in door guard 10 and door guard 30.

Figure 5A:
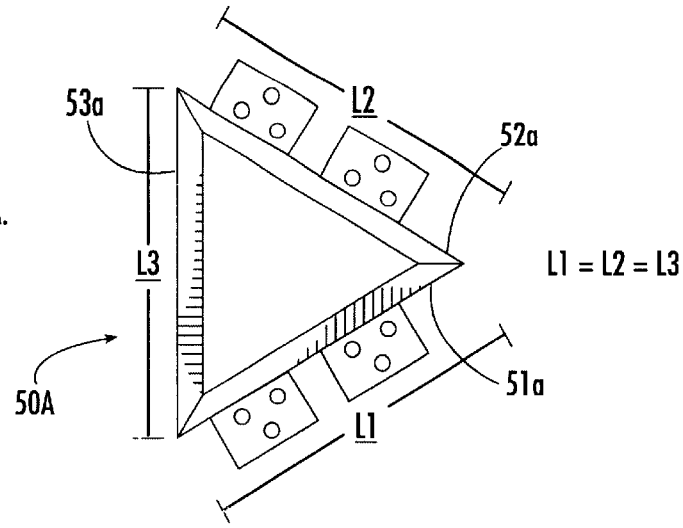
FIG. 5A is a top plan view of another door guard according to one embodiment of the invention.
Figure 5B:
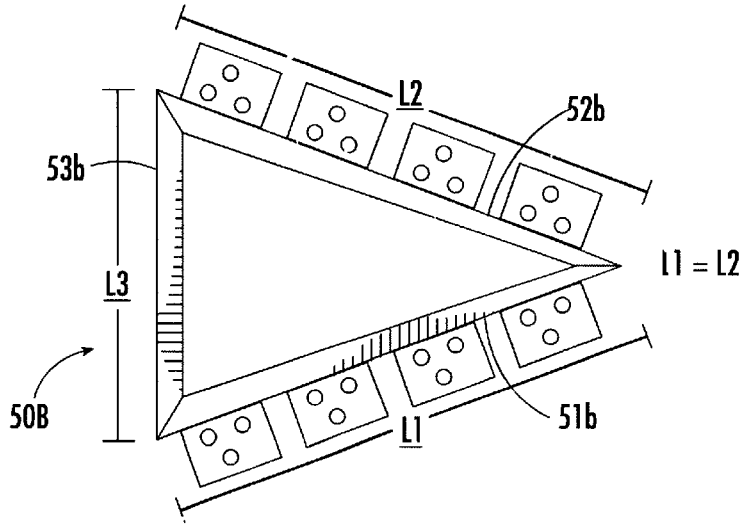
FIG. 5B is a top plan view of another door guard according to one embodiment of the invention.
Figure 5C:
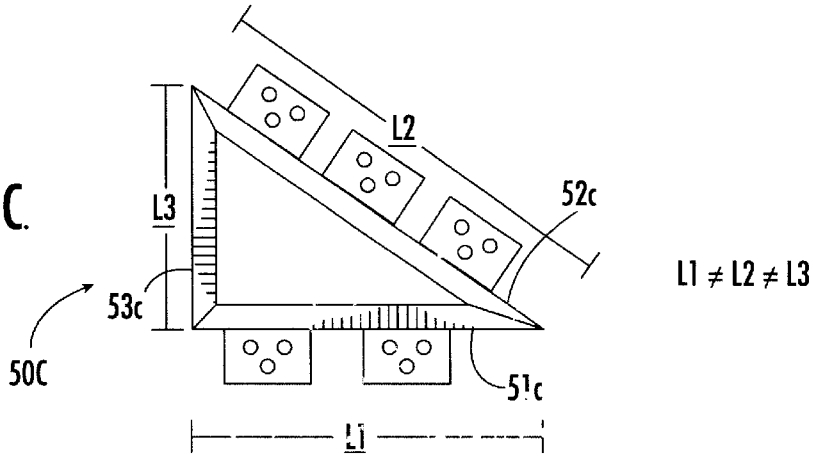
FIG. 5C is a top plan view of another door guard according to one embodiment of the invention.

Referring now to FIG. 5A, a door guard according to another embodiment of the invention is shown generally at reference numeral 50A. Door guard 50A defines an equilateral triangle including edges 51*a*, 52*a* and 53*a* having equal lengths "L1", "L2" and "L3",respectively. FIG. 5B shows another embodiment of the invention at reference numeral 50B. Door guard 50B defines an isosceles triangle including edges 51*b*, 52*b* and 53*b*, having lengths "L1", "L2" and "L3", respectively, wherein the lengths "L1" and "L2" of 51*b* and 52b, respectively, are equal. FIG. 5C shows yet another embodiment of the door guard at reference numeral 50C. The door guard 50C is shown defining a scalene triangle including edges 51c, 52c and 53c having unequal lengths "L1", "L2", and "L3", respectively. Door guards

50A, 50B, and 50C are comprised of the same materials and include the same components as the door guard 50 shown in FIG. 4.

Figure 6:
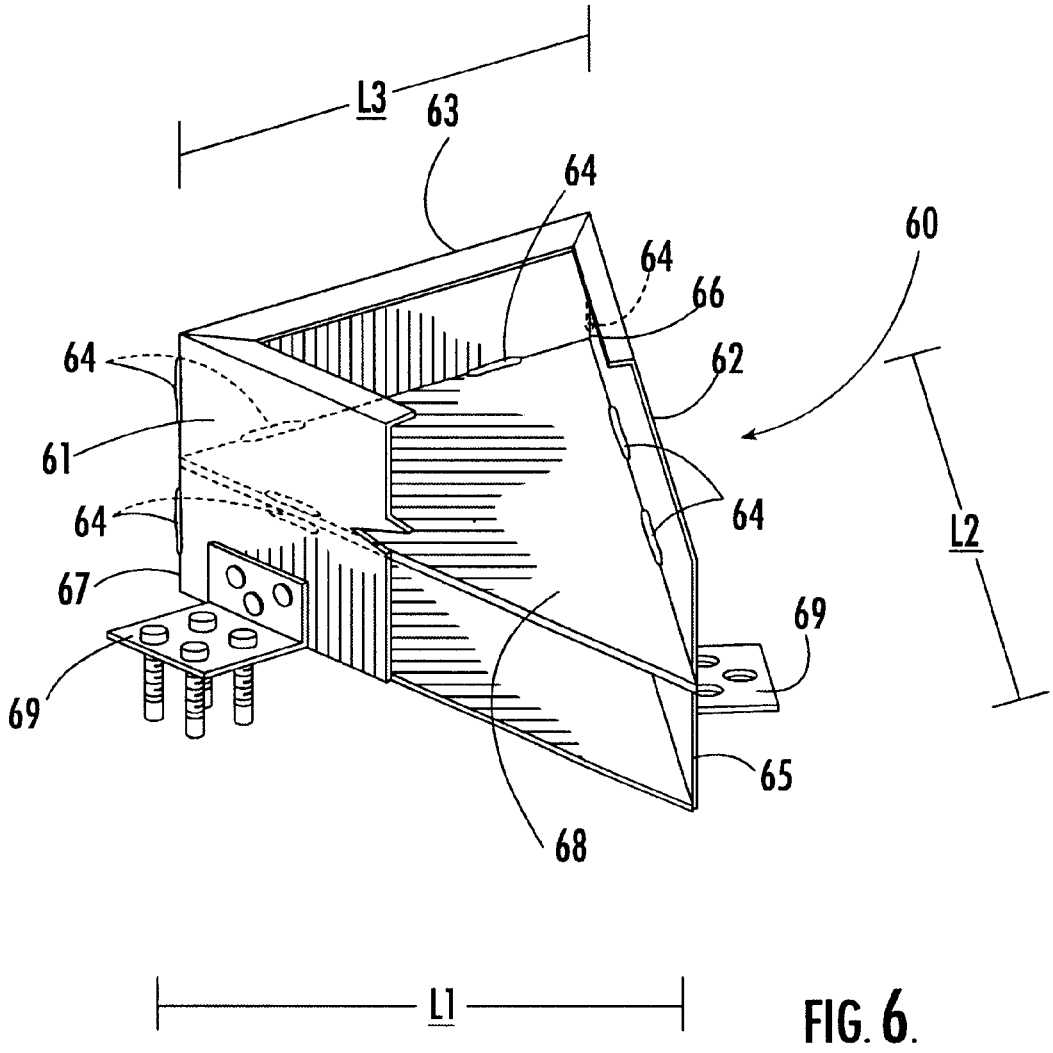
FIG. 6 is a cut-away perspective view of another door guard according to one embodiment of the invention.

Referring now to FIG. 6, a door guard according to another embodiment of the invention is shown generally at reference numeral 60. The door guard 60 is preferably wedge-shaped, and includes first, second and third faces 61, 62, and 63, respectively, which intersect and are attached together by welded seams 64 to form respective converging edges 65, 66 and 67. Faces 61, 62 and 63 have respective lengths "L1", "L2" and "L3". Each face 61, 62, or 63 is preferably formed from a steel plate having a thickness of approximately ½ inch, and includes upper and lower inwardly-facing reinforcements. The door guard 60 also includes a reinforcement member 68 for providing additional support to the door frame 60 during impact with a colliding object. The reinforcement member 68 is attached to the interior of faces 61, 62 and 63 by welded seams 64. The reinforcement member 68 may be triangularly-shaped, planar, or may have a shape and size that differs from the shape and size of the door guard 60. The door guard 60 also includes a plurality of attachment plates 69 attached along the bottom edges of faces 61 and 62 for anchoring the door guard 60 to a floor. Each plate 69 is formed from the same materials, includes the same components, and is installed in the same manner as the plates 26, 40 and 58, which are employed in door guards 10, 30 and 50, respectively.

In one embodiment of the present invention, a door guard 60A defines a scalene triangle with faces 61*a*, 62*a* and 63*a* having unequal lengths "L1", "L2" and "L3", respectively (Not shown). In another embodiment, a door guard 60B defines an isosceles triangle wherein faces 61*b* and 62*b* have equal lengths (L1=L2) (Not shown). In a third embodiment, a door guard 60C defines an equilateral triangle wherein faces 61*c*, 62*c* and 63*c* have equal lengths (L1=L2=L3)(Not shown).

Figure 7:
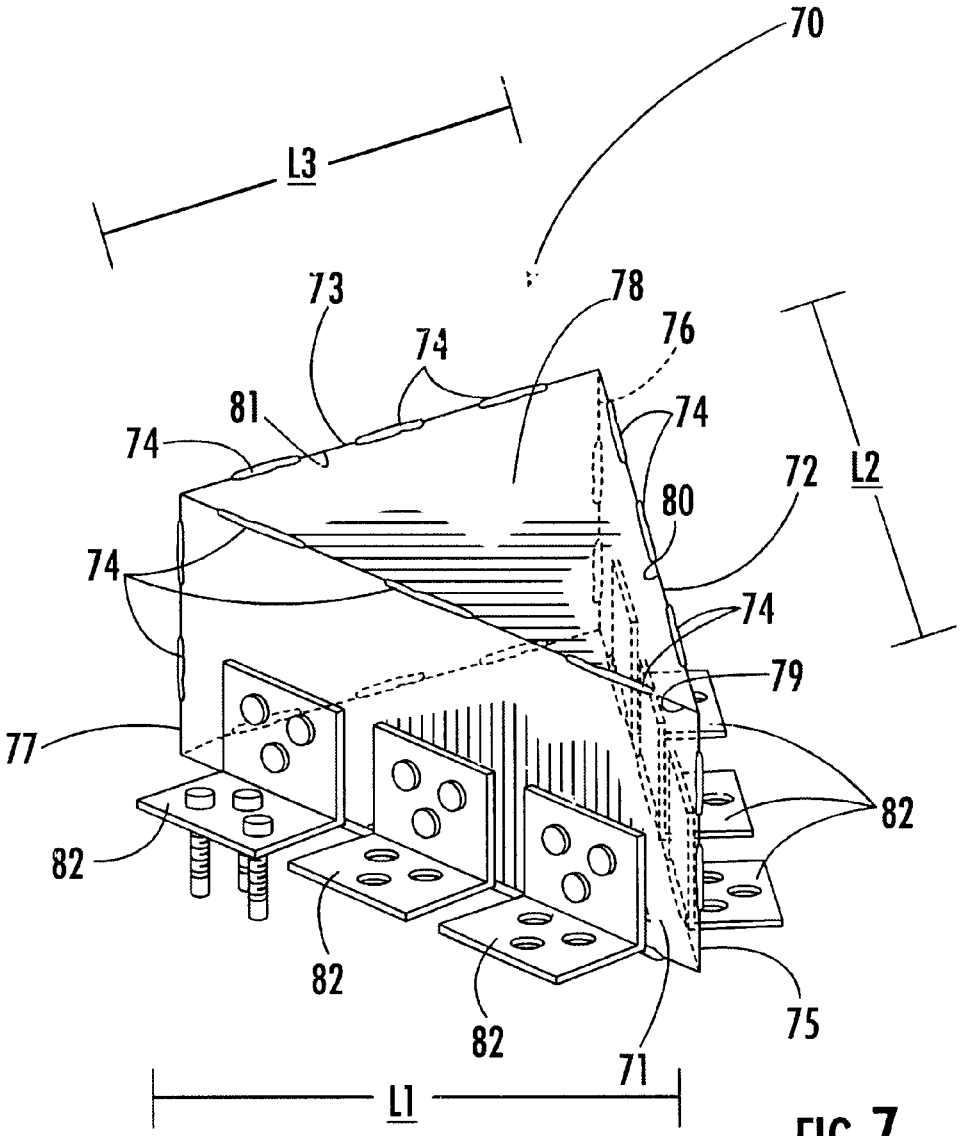
FIG. 7 is a perspective view of another door guard according to one embodiment of the invention.

Referring now to FIG. 7, a door guard according to another embodiment of the invention shown generally at reference numeral 70. The door guard 70 is preferably wedge-shaped, and includes first, second and third faces 71, 72, and 73, respectively, which intersect and are attached together by welded seams 74 to form respective converging edges 75, 76 and 77. Faces 71, 72, and 73 are preferably formed from steel plates having a thickness of approximately ½ inch, and includes upper and lower inwardly-facing reinforcements. The door guard 70 also includes a top 78, which is attached to faces 71, 72 and 73 by welded seams 74 to form converging upper edges 79, 80 and 81. Faces 71, 72 and 73 have respective lengths "L1", "L2" and "L3". The top 78 is preferably formed from a steel plate having a thickness of approximately 3⁄16". The door guard 70 also includes a plurality of attachment plates 82 attached along the bottom edges of faces 71 and 72 for anchoring the door guard 70 to a floor. The door guard 70 may also be attached at least halfway up the side of a doorframe using a plurality of attachment plates 82. Each plate 82 is formed from the same materials, includes the same components, and is installed in the same manner as the plates 26, 40 and 58 employed in door guards 10, 30 and 50.

Figure 8:
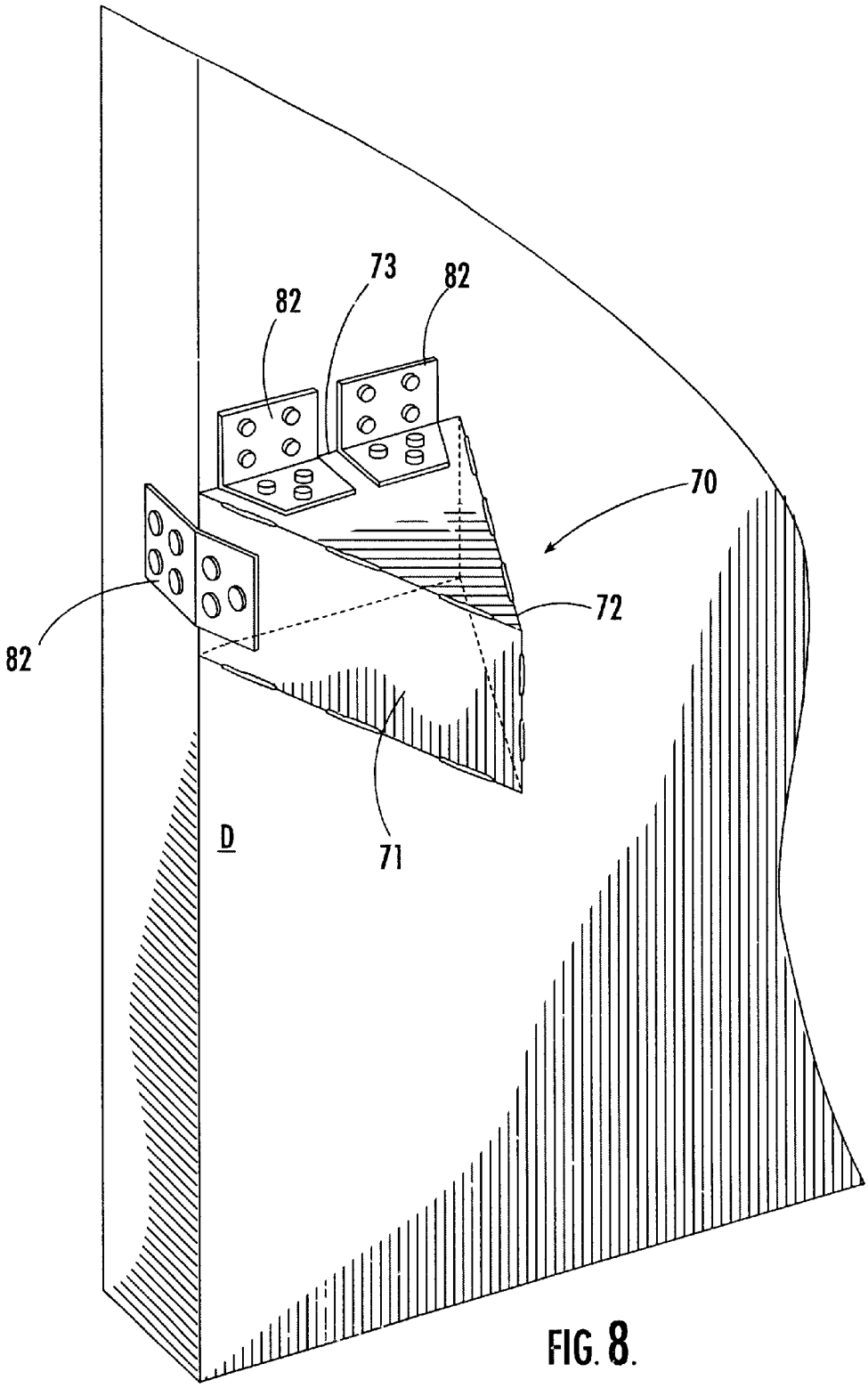
FIG. 8 is a perspective view of the door guard according to FIG. 7.
Figure 9:
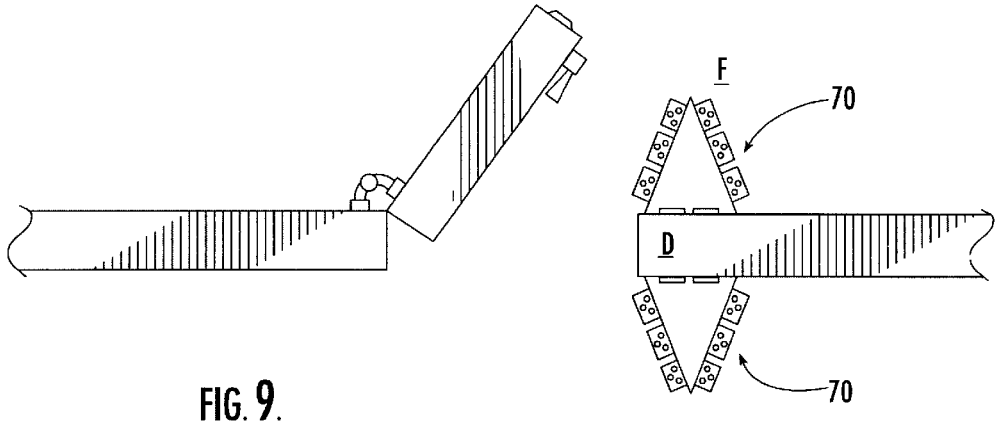
FIG. 9 is a top plan view of multiple door guards according to FIG. 8.

In one embodiment of the present invention, a door guard 70A defines a scalene triangle with faces 71*a*, 72*a* and 73*a* having unequal lengths "L1", "L2" and "L3," respectively (Not shown). In another embodiment, a door guard 70B defines an isosceles triangle wherein faces 71*b* and 72*b* have equal lengths (L1=L2) (Not shown). In a third embodiment, a door guard 70C defines an equilateral triangle wherein faces 51*c*, 52*c* and 53*c* have equal lengths (L1=L2=L3)(Not shown). FIG. 8 shows the door guard 70 anchored adjacent to, and at least halfway up, the side of a doorframe "D". FIG. 9 shows multiple door guards 70 positioned adjacent to a doorframe "D" and on opposite sides of the doorframe "D". Positioning each door guard 70 in this manner permits the door guards 70 to cooperate with each other to deflect colliding objects away from the doorframe "D".

Figure 10:
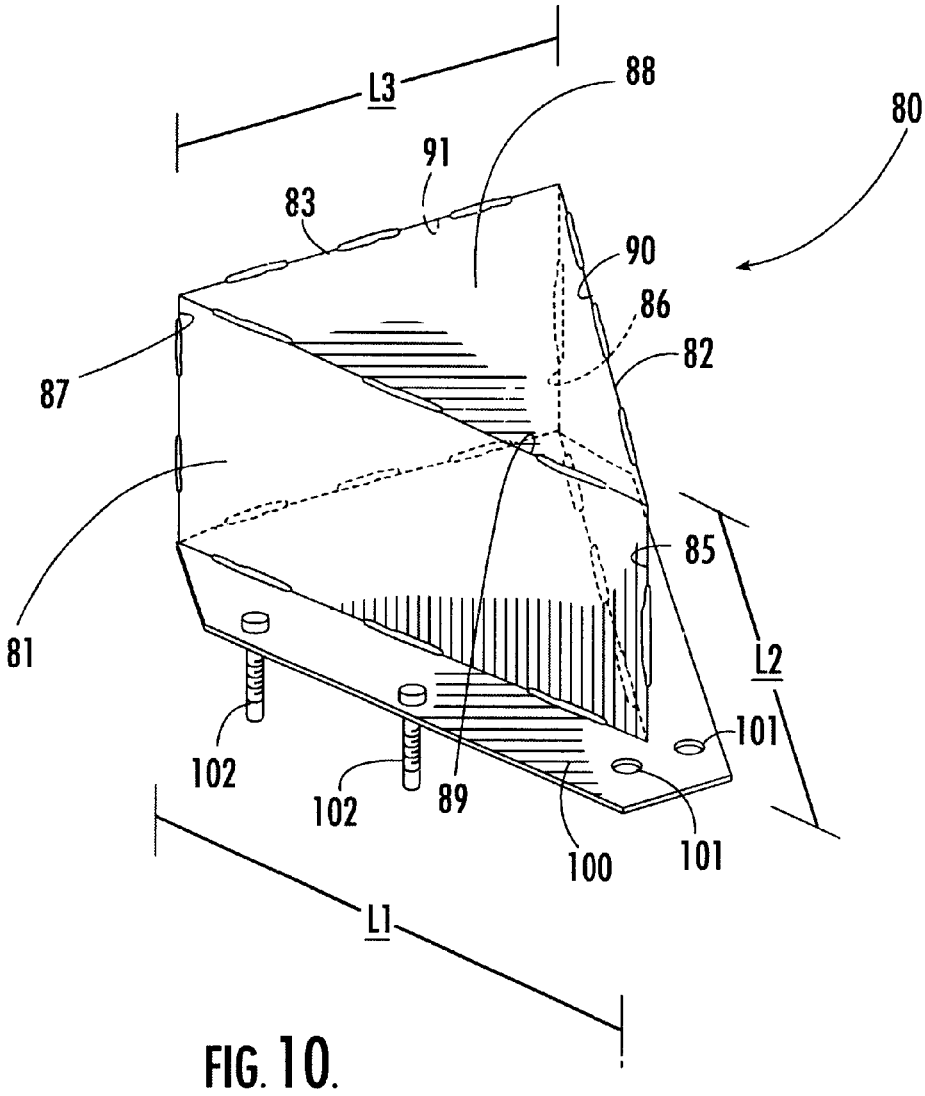
FIG. 10 is a perspective view of another door guard according to one embodiment of the invention.

Referring now to FIG. 10, a door guard according to the present invention is shown generally at reference numeral 80. Like the door guard 70, the door guard 80 is preferably wedge-shaped, and includes first, second and third faces 81, 82, and 83, respectively, which intersect and are attached together by welded seams 84 to form respective converging edges 85, 86 and 87. Faces 81, 82, and 83 are preferably formed from steel channels having a thickness of approximately ½ inch, and upper and lower inwardly-facing reinforcements. The door guard 80 also includes a top 88, which is attached to faces 81, 82 and 83 by welded seams 84 to form converging upper edges 89, 90 and 91. Faces 81, 82 and 83 have lengths "L1", "L2" and "L3", respectively. Unlike the door guard 70, however, the door guard 80 includes an outwardly extending flange 100, which is attached to lower edges 95, 96 and 97 of respective faces 81, 82 and 83 and is adapted for securing the door guard 80 to a floor. The top 88 and the flange 100 are preferably formed from steel plates having a thickness of approximately 3⁄16 inch. The flange 100 includes a plurality of spaced-apart holes 101. Each hole 101 is preferably drilled through the flange 100 using a hammer drill, is threaded, and has a diameter of approximately ½ inch adapted for receiving a complementary anchor 102 therethrough. Although any suitable concrete anchor may be used, the anchor 102 is preferably a wedge-type expansion anchor having a diameter equal to that of the hole 101, which permits the hole 101 to receive the anchor 102 for securing the door guard 80 to a floor. The flange 100 is anchored to the inside of faces 82 and 83 by a plurality of bolts 103 inserted through complementary holes 104 (Not shown). Although the holes 104 may be any diameter, each hole 104 preferably has a diameter of ½ inch. Furthermore, any suitable bolt may be used; however, each bolt 103 preferably includes an Allen head and has a diameter of ½ inch.

In one embodiment of the present invention, a door guard 80A defines a scalene triangle with 81*a*, 82*a* and 83*a* having unequal lengths "L1", "L2" and "L3," respectively (Not shown). In another embodiment, a door guard 80B defines an isosceles triangle wherein faces 81*b* and 82*b* have equal lengths (L1=L2) (Not shown). In a third embodiment, a door guard 80c defines an equilateral triangle wherein faces 81*c*, 82*c* and 83*c* have equal lengths (L1=L2=L3) (Not shown).

Figure 11:
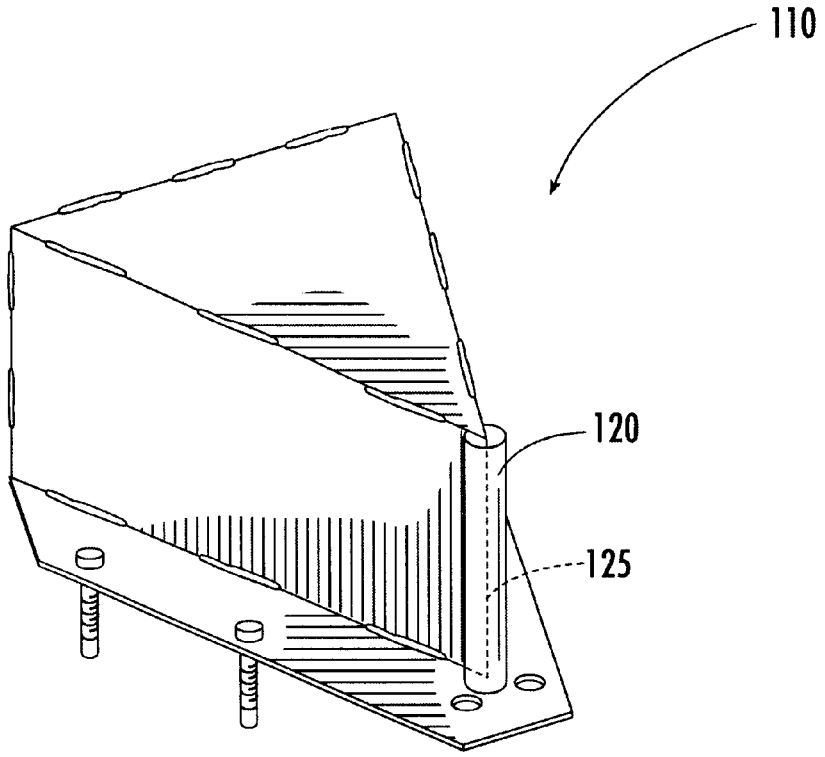
FIG. 11 is a perspective view of another door guard according to one embodiment of the invention.

Referring now to FIG. 11, a door guard according to the present invention is shown generally at reference numeral 110. The door guard 110 is identical to the door guard 80 in all respects, except that the door guard 10 includes a cap 120 sealingly attached to, extending along and covering an outwardly extending edge 125, which is shown drawn in phantom. The cap 120, is preferably formed from rubber, and is adapted to absorb the direct impact of a colliding object, thereby minimizing damage resulting to the object and a doorframe caused by the collision. The cap 120 may also be included in the door guards 30, 50, 50A, 50B, 50C, 70 and 80 shown in FIGS. 3–9.

Figure 12:
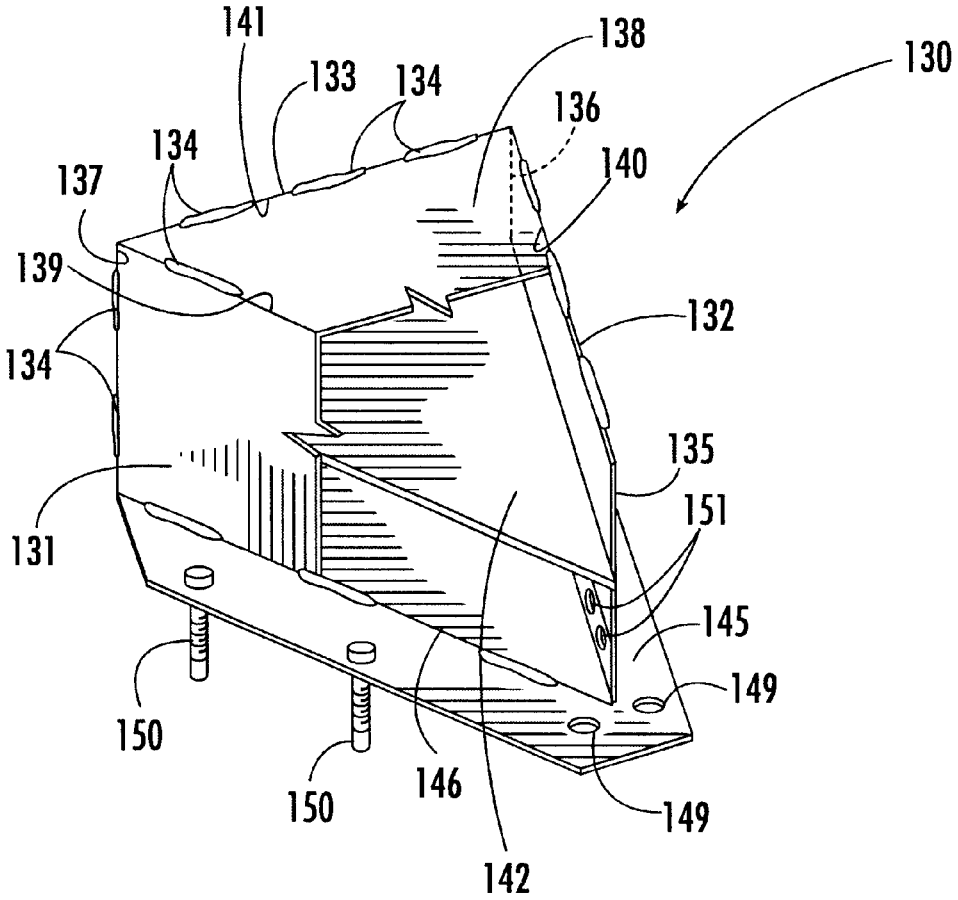
FIG. 12 is a cut-away perspective view of another door guard according to one embodiment of the invention.

Referring now to FIG. 12, a door guard according to the present invention is shown generally at reference numeral 130. Like the door guards 70, 80 and 110, the door guard 130 is preferably wedge-shaped, and includes first, second and third faces 131, 132, and 133, respectively, its which intersect and are attached together by welded seams 134 to form respective converging edges 135, 136 and 137. Faces 131, 132, and 133 are preferably formed from steel plates having a thickness of approximately ½ inch, and upper and lower inwardly-facing reinforcements. The door guard 130 includes a top 138, which is attached to faces 131, 132 and 133 by welded seams 134 to form converging upper edges 139, 140 and 141. Faces 131, 132 and 133 have lengths "L1", "L2" and "L3", respectively.

The door guard 130 also includes a reinforcement member 142, which is attached to the interior of faces 131, 132 and 133 by welded seams 134, and is adapted for providing additional to the door frame 130 during impact with a colliding object. The reinforcement member 142 may be triangularly-shaped, planar, or may have a shape and size that differs from the shape and size of the door guard 130. In addition, the door guard 130 includes an outwardly-extending flange 145, which is attached to lower edges 146, 147 and 148 (edges 147 and 148 are not shown) of respective faces 131, 132 and 133 and is adapted for securing the door guard 130 to a floor. The top 138, the reinforcement member 142 and the flange 145 are preferably formed from steel plates having a thickness of approximately 3⁄16". Faces 131, 132 and 133 are preferably formed from steel plates having a thickness of ½". The flange 145 includes a plurality of spaced-apart holes 149. Each hole 149 is preferably drilled through the flange 145 using a hammer drill, is threaded, and has a diameter of approximately ½ inch adapted for receiving a complementary anchor 150 therethrough. Although any suitable concrete anchor may be used, the anchor 150 is preferably a wedge-type expansion anchor having a diameter equal to that of the hole 149, which permits the hole 149 to receive the anchor 149 for securing the door guard 130 to a floor. The flange 145 is anchored to the inside of faces 132 and 133 by a plurality of bolts 151 inserted through complementary holes 152 (Not shown). Although the holes 152 may be any diameter, each hole 152 preferably has a diameter of ½ inch. Furthermore, any suitable bolt may be used; however, each bolt 151 preferably includes an Allen head and has a diameter of ½ inch.

In one embodiment of the present invention, a door guard 130A defines a scalene triangle with faces 131*a*, 132*a* and 133*a* having unequal lengths "L1", "L2" and "L3," respectively (Not shown). In another embodiment, a door guard 130B defines an isosceles triangle wherein faces 131*b* and 132*b* have equal lengths (L1=L2) (Not shown). In a third embodiment, a door guard 130C defines an equilateral triangle wherein faces 131*c*, 132*c* and 133*c* have equal lengths (L1=L2=L3) (Not shown).

In each of the embodiments of the invention described above, the welded seams 39, 54, 64, 74, 84 or 134 are preferably continuous welds; however, spot welds may also be used. Furthermore, each of the door guards described herein may be attached at any location along a doorframe.

A door guard for deflecting a colliding object away from the frame of a door has been disclosed. Various details of the invention may be changed without departing from its scope. Furthermore, the foregoing description of the preferred embodiments of the invention and the best mode for practicing the invention are provided for the purpose of illustration only and not for the purpose of limitation—the invention being defined by the claims.

I claim:

1. A door guard for protecting a doorframe surrounding a doorway, comprising:

(a) a deflecting member having a vertically-oriented, planar, and horizontally-elongate deflecting surface adapted for being positioned adjacent to a side of the doorframe, thereby permitting said deflecting surface to project outwardly from the doorframe at an oblique angle thereto for deflecting a colliding object away from the doorframe and into the doorway;

(b) at least one anchor on the door guard for affixing the door guard to an anchoring surface adjacent the doorframe; and (c) a reinforcement member positioned intermediate top and bottommost portions of said deflecting member for providing additional support to the deflecting member.

2. A door guard according to claim 1, wherein said deflecting member (a) comprises a dihedrally-shaped converging surface including two faces intersecting to form an outwardly extending edge (where "13" and "11" meet).

3. A door guard according to claim 1, wherein said deflecting member (a) comprises a wedge-shaped structure, said structure including at least one vertically-oriented face (10).

4. A door guard according to claim 3, wherein said wedge-shaped structure defines an isosceles triangle having an unequal side positioned in alignment with, and two equal sides affixed together by attachment means and converging outwardly away from, the doorframe.

5. A door guard according to claim 3, wherein said wedge-shaped structure includes first, second and third equilateral sides affixed together by attachment means, thereby forming the wedge-shaped structure, wherein said first equilateral side is for being positioned in alignment with the doorframe, thereby permitting said second and third equilateral sides to converge outwardly from the doorframe.

6. A door guard according to claim 4 or 5, wherein said sides have a length at least two times greater than the height of the sides.

7. A door guard according to claim 1 or 3, wherein said anchor comprises an outwardly extending attachment flange adapted for securing the deflecting member to a floor, said flange attached to the deflecting member and including a plurality of spaced-apart holes defined by the flange, wherein said holes are adapted for receiving bolts therethrough.

8. A door guard according to claim 1, wherein said guard is comprised of steel.

9. A door guard according to claim 1, wherein said guard is comprised of a high density plastic.

10. A door guard according to claim 6, wherein said attachment means comprises a plurality of welded seams.

11. A door guard according to claim 2, wherein said outwardly extending edge includes a rubber cap extending along and covering the edge, wherein said cap is adapted for absorbing the direct impact of a colliding object and for minimizing damage resulting to the object and the doorframe from the impact.

12. A door guard assembly comprising a pair of door guards according to claim 1, wherein said door guards are positioned adjacent the doorframe and on opposite sides of the doorway for cooperating to deflect colliding objects away from the doorframe.

* * * * *